US005404604A

United States Patent [19]

Has et al.

[11] Patent Number: 5,404,604

[45] Date of Patent: Apr. 11, 1995

[54] ADJUSTING DEVICE FOR A BED OR CHAIR

[75] Inventors: Peter V. Has, Haaksbergen; Andreas J. L. Nijsen, Weerselo, both of Netherlands

[73] Assignee: Koninklijke Auping B.V., Deventer, Netherlands

[21] Appl. No.: 897,043

[22] Filed: Jun. 11, 1992

[30] Foreign Application Priority Data

Jun. 14, 1991 [NL] Netherlands ..... 9101035

[51] Int. Cl.[6] ..... A61G 7/015; A61G 7/002

[52] U.S. Cl. ..... 5/617

[58] Field of Search ..... 5/617, 618, 616, 613

[56] References Cited

U.S. PATENT DOCUMENTS

| | | | |
|---|---|---|---|
| 3,646,621 | 3/1972 | Fragas | 5/617 |
| 4,005,497 | 1/1977 | Sutter | 5/617 |
| 4,535,492 | 8/1985 | Sebest | 5/617 |

FOREIGN PATENT DOCUMENTS

| | | | |
|---|---|---|---|
| 0214695 | 3/1987 | European Pat. Off. . | |
| 0250646 | 1/1988 | European Pat. Off. . | |
| 8914070 | 1/1990 | Germany . | |
| 3844668 | 5/1990 | Germany | 5/617 |
| 587035 | 4/1977 | Switzerland | 5/617 |
| 8304168 | 12/1983 | WIPO . | |

*Primary Examiner*—Alexander Grosz
*Attorney, Agent, or Firm*—Leydig, Voit & Mayer

[57] ABSTRACT

A device for supporting a human body is provided having parts which are movable relative to each other including a frame; a rotatable end connected thereto; a base element which is connected to the rotatable end; an adjusting element which cooperates with a frame section; and drive means for adjusting the adjusting element relative to the base element, the base element being an elongated section running parallel to at least one of the parts of the frame and the rotatable end and the adjusting element including first and second arms which are movable by means of the drive means between a position in which it extends along or is accommodated in the section and a position in which it projects relative to the section, which arm can be swivelled about a fixed hinge point of the frame and which forms part of a link mechanism with two arms, of which the second arm is coupled with play in a pivoting manner to a sliding member which can be moved relative to the frame, and which second arm has a part which can cooperate in such a way with a control face of the sliding member that the second arm swings out of the initial position at an obtuse angle relative to the first arm, before the play has been passed through.

33 Claims, 4 Drawing Sheets

ADJUSTING DEVICE FOR A BED OR CHAIR

The invention relates to a device for moving, and/or locking relative to each other, adjustable parts such as a frame of a bed or chair and a head or foot end, or a seat or back part, rotatably connected thereto. The device is provided with a base element which interacts with one of the parts movable relative to each other, an adjusting element which interacts with the other part, and also drive means for adjusting the adjusting element relative to the base element. Such a device is known from the international application WO 83/00805. It comprises two frameworks rotatably connected to each other by means of a hinge pin. These frameworks are adjustable relative to each other between a position in which they lie flat on each other and a position in which they form an angle between them. The adjusting means are accommodated in one of the frameworks. They comprise gas springs which are permanently under pressure, in such a way that the adjustment of the frameworks from their position flat on each other is achieved by releasing the gas springs so that they can expand.

In the position in which the frameworks are flapped on top of each other this device has a relatively small thickness measurement. The overall height is consequently low, which has structural and aesthetic advantages in the case of applications in a bed or chair.

This device has, however, the following disadvantages. The dimensions are virtually the same as those of the adjustable part, with the result that it is of both great length and width, which still limits the fitting possibilities, despite the low thickness measurement. A further disadvantage is that the gas springs produce permanent pre-tensions in the device, which can lead to play and rattling noises in the structure when the frameworks are collapsed.

The object of the invention is, therefore, to provide a device of the type described above which does not have these disadvantages and which permits a particularly compact fitting. This is achieved through the fact that the base element is an elongated section running parallel to the frame or a part adjustable with respect thereto, and that the adjusting element is an arm which is movable by means of the drive means between a position in which it extends along or is accommodated in the elongated section and a position in which it extends in a direction of movement relative to the section.

The device according to the invention, when collapsed, is roughly the shape of a section with a relatively large length measurement but with a cross-section with two relatively small transverse measurements. This design has numerous fitting possibilities: for example single or double, or in the lengthwise or in the transverse direction of the adjustable part.

Provision is made at or near the projecting end of the arm for a supporting device which interacts with one of the parts adjustable relative to each other.

The elongated section of the device can be fixed either to the base frame or to the adjustable part. According to a preferred embodiment, the section is fixed to an adjustable part, and the supporting device is a roller element or sliding element which can roll or slide over a supporting element of which the surface facing the roller element forms a roller track or sliding track. Different embodiments of the device according to the invention are possible. According to a first embodiment, the section has an essentially U-shaped cross-section, and the adjusting element is a link mechanism which can be accommodated in the section. The link mechanism is adjustable between a virtually stretched out position in which it lies in the U-shaped section and a scissored position in which it projects.

As an alternative, the section could also have an L-shaped or T-shaped cross-section. The link mechanism can then be situated on one side of the vertical leg of the L or T. The link mechanism could also be made double, in such a way that it surrounds the leg at both sides. In the embodiment in which the section is fixed to the adjustable part, during adjusting movements of the device the link hinge describes a path which is partly determined by the rotation of the adjustable part. This can be used to obtain the greatest possible angle of rotation of that part by giving the supporting element, viewed in the direction towards the free end of the adjustable part in the collapsed position, an upgoing roller track or sliding track. The result is that, as the adjustable part is flipped further up, the roller element lies higher and higher up. This means that the angle of rotation of the adjustable part also increases accordingly.

A reduction of the total height measurement of the device in the collapsed position can be achieved if the roller element is situated on an extension of the link arm running past the link hinge and lying at the side of the hinge suspension of the adjustable part. The straight line running through both hinge axes of the link arm provided with the extension can consequently form an angle other than 180 degrees with the straight line running through the link hinge axis and the roller axis of the roller element.

In the collapsed position of the device the link mechanism is virtually stretched out. In order to avoid too great tensile and pressure forces occurring as a result at the beginning of an adjusting movement, the link arm is rotatably accommodated in a slotted hole provided in the slide block which runs in the lengthwise direction of the base element. The slide block has at its side facing the suspension point of the other link arm a run-on face running up in that direction, while the link arm connected to the slide block also has a run-on roller or slide which can be rolled or slid along said run-on face in such a way that when the slide block is slid towards the other link arm the run-on roller or run-on slide rolls or slides along the run-on face and in the process moves away from the base element while turning the link arms to a more scissored position.

The slide drive of the slide block can be achieved in various ways. According to a first possibility, the slide block is connected to a pulling cable which can be wound onto a take-up element provided near the hinge suspension of the adjustable part.

A suitable drive ratio between the motor driving the take-up element and the adjustable part can be obtained if the slide block contains a cable reel over which a pulling cable is stretched, and the take-up element is a cable drum comprising two drum halves of different diameters, onto which drum the two parts of the pulling cable running off the cable reel run at sides lying opposite each other relative to the axis of rotation of the cable drum. The desired drive can be ensured by selecting a suitable diameter ratio of the drum halves.

According to a second possibility, the slide drive can be achieved by means of a lead screw which is coupled to the slide block, and which is suspended near the hinge suspension of the adjustable part so that it at least rotates about its longitudinal axis.

According to a third possibility, the slide block is provided with a pawl which interacts with a ratchet supported near the hinge suspension of the adjustable part, in such a way, that on raising the adjustable part, the pawl can roll over the ratchet but is blocked in the opposite direction.

The slide block can be guided in the section through the fact that the flanges of the U-shaped base element determine a cross-section with undercut hollow and run towards each other, bent through an essentially right angle, at a distance from the bottom of the U-shaped cross-section, in such a way that the bottom and the parts of the base element running towards each other form roller tracks along which guide rollers provided on the slide block can be rolled.

A number of examples of embodiments of the device according to the invention will be explained in greater detail below.

FIG. 3 shows a second embodiment of the device, with the adjustable part flipped down.

Figures 1, 4:
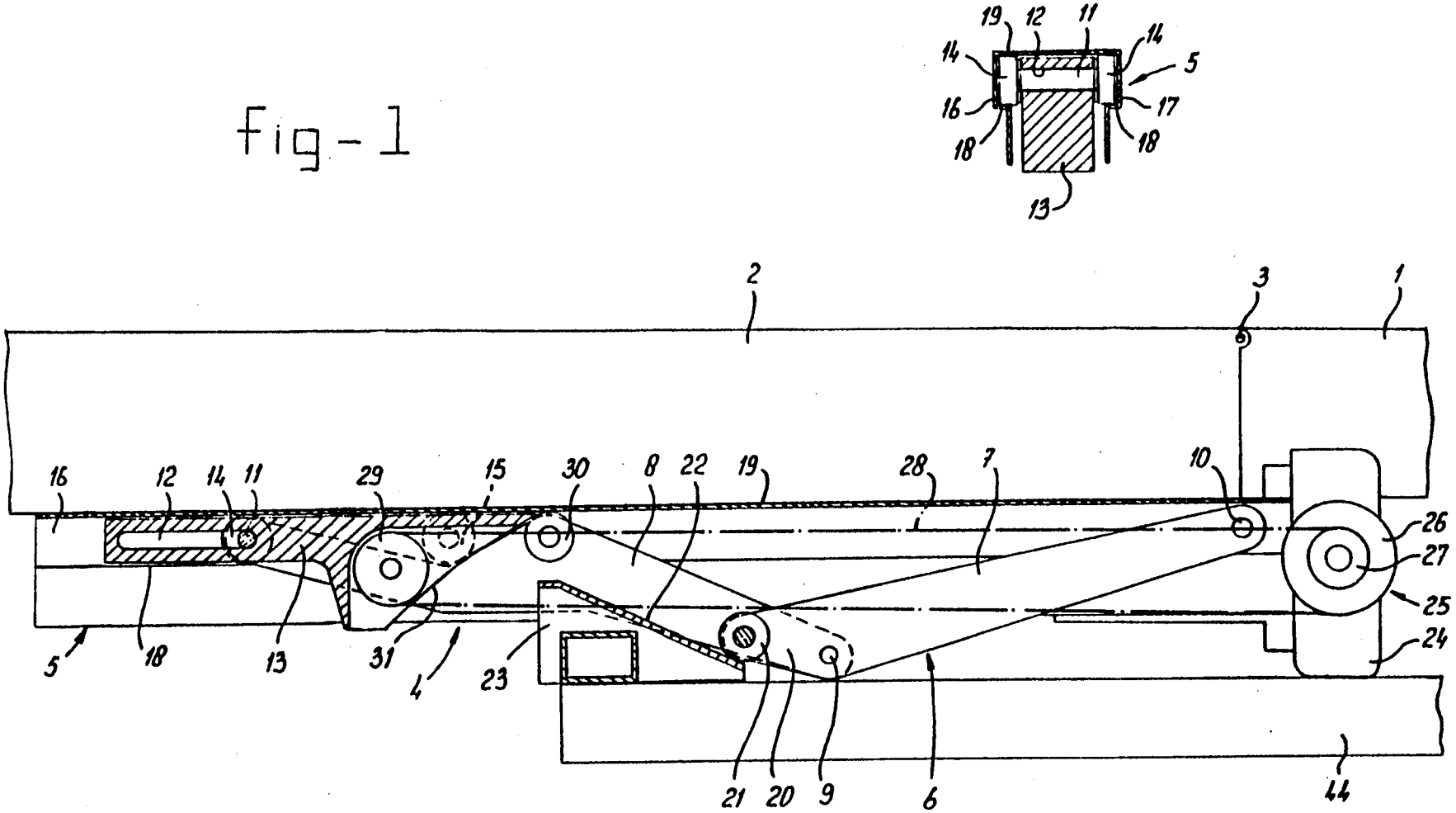
FIG. 1 shows a side view of a first embodiment, with the adjustable part flipped down.
FIG. 4 shows a cross-section of FIG. 1.

The side view shown in FIG. 1, partially in cross-section, shows a part of a lying surface, such as a bed frame, near the hinge point between a fixed frame part 1 and a flip-up part 2. These parts 1, 2 are interconnected by means of hinge 3. An adjusting device, indicated in its entirety by 4, is connected to the flip-up part 2. This adjusting device comprises a section 5 with an essentially U-shaped cross-section, of which the opening faces downwards. This U-shaped section accommodates a link mechanism which is indicated in its entirety by 6. It comprises a first link arm 7 and a second link arm 8, which are connected to each other at the position of link hinge 9. The first link arm 7 is suspended in the U-shaped section 5 in such a way that it rotates by means of hinge 10. Second link arm 8 is rotatably suspended from pin 11. This pin 11 is slidable in a slotted hole 12 which is provided in slide block 13. This slide block 13 can be slid in the U-shaped section 5 by means of wheels 14, 15.

As shown in FIG. 4, the legs 16, 17 of the U-shaped section 5 for this purpose are turned inwards along about half of their height measurement. This provides roller surfaces 18 on which the wheels 14, 15 can-roll. These wheels 14, 15 are in fact accommodated in a close fit between the bottom 19 and the roller surfaces 18 of the U-shaped section 5.

The first link arm 7 is extended past the link hinge 9 by means of an extension 20. Provided at the end of this extension 20 is a roller element 21 which can roll along the roller track 22 situated on supporting element 23. Supporting element 23 is fixed on frame part 44, which is fixed relative to frame part 1.

In the embodiment shown, a drive unit 24, not shown in detail, is also fixed to the U-shaped section, which drive unit is provided with a drum 25 having a drum half 26 with a large diameter and a drum half 27 with a small diameter. A pulling cable 28 runs on these drum halves 26, 27, diametrically opposite each other, the pulling cable being guided over roller 29. Roller 29 is rotatably accommodated in the slide element 13. Turning drum 25 to the left in the drawing causes the roller element 29 with slide element 13 to be pulled to the right in the drawing. A desired delay can be obtained by making a suitable selection of the ratio of the diameters of the drum halves 26 and 27.

In order to avoid excessive adjusting forces in the link mechanism when it is in its extended position shown in FIG. 1, an auxiliary roller 30, which can be rolled along a roller track 31 on the supporting element 13, is fixed to the second link arm 8. When the cable 28 is shortened, only the slide element 13 slides in the first instance; the pin 11 initially does not move, due to the fact that the slotted hole 12 moves to the right relative to said pin 11. As soon as pin 11 goes against the other end of slotted hole 12, link arm 8 is also pressed to the right. In that position, however, the link arm 8—and thus also the link arm 7—is already partially scissored out. On a movement of the slide element 13 to the right, the auxiliary roller 30 is in fact pressed downwards over the roller track 31, which produces a first scissor movement to a greater scissored position of the link mechanism 6.

After that, the pin 11 begins to interact with the slotted hole 12 in question, and the scissor movement can be continued through further shortening of the cable 28.

Figure 2:
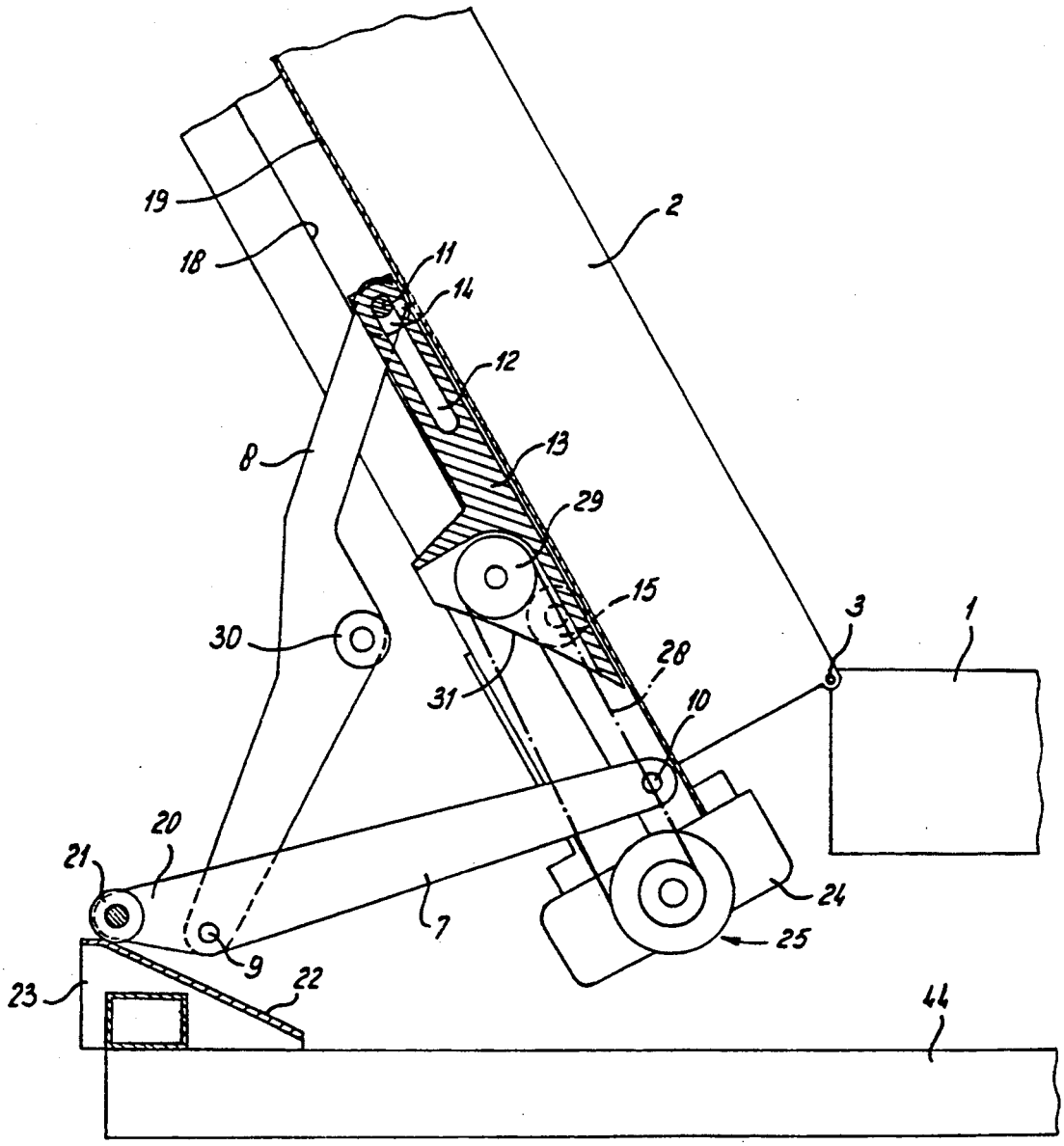
FIG. 2 shows a view corresponding to FIG. 1, with the adjustable part flipped up.

As shown in FIG. 2, as adjustable part 2 is flipped up further, the roller 21 rolls over roller surface 22 of supporting element 23. Supporting roller 21, and thus link hinge 9, consequently comes to lie increasingly high up, as a result of which the maximum angular rotation of adjustable part 2 which can be achieved increases.

FIG. 3 shows a second possible embodiment of the device according to the invention. In this case the cable drive with drum and cable roller is replaced by a lead screw drive 32. It has a lead screw 33, a worm wheel 34, a worm 35, and a motor 36 driving the worm 35. At the end where the worm wheel 34 is situated the lead screw 33 is fixed by means of a bearing 37 so that it cannot slide in the U-shaped section 5.

At its other end the lead screw 33 is accommodated in a nut 38, which is in turn held in the sliding element 13. The nut 38 is fixed so that it cannot rotate about the axis of lead screw 33; it can rotate in two directions at right angles thereto. For this purpose, the nut 38 has a partially convex surface 39 which is accommodated in a correspondingly shaped inner surface 40 in supporting element 13. Deviations in the straight shape of lead screw 33 can be absorbed in this way.

Figure 5:
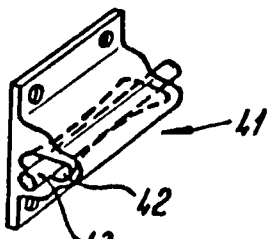
FIG. 5 shows a detail of FIG. 3.
Figure 7:
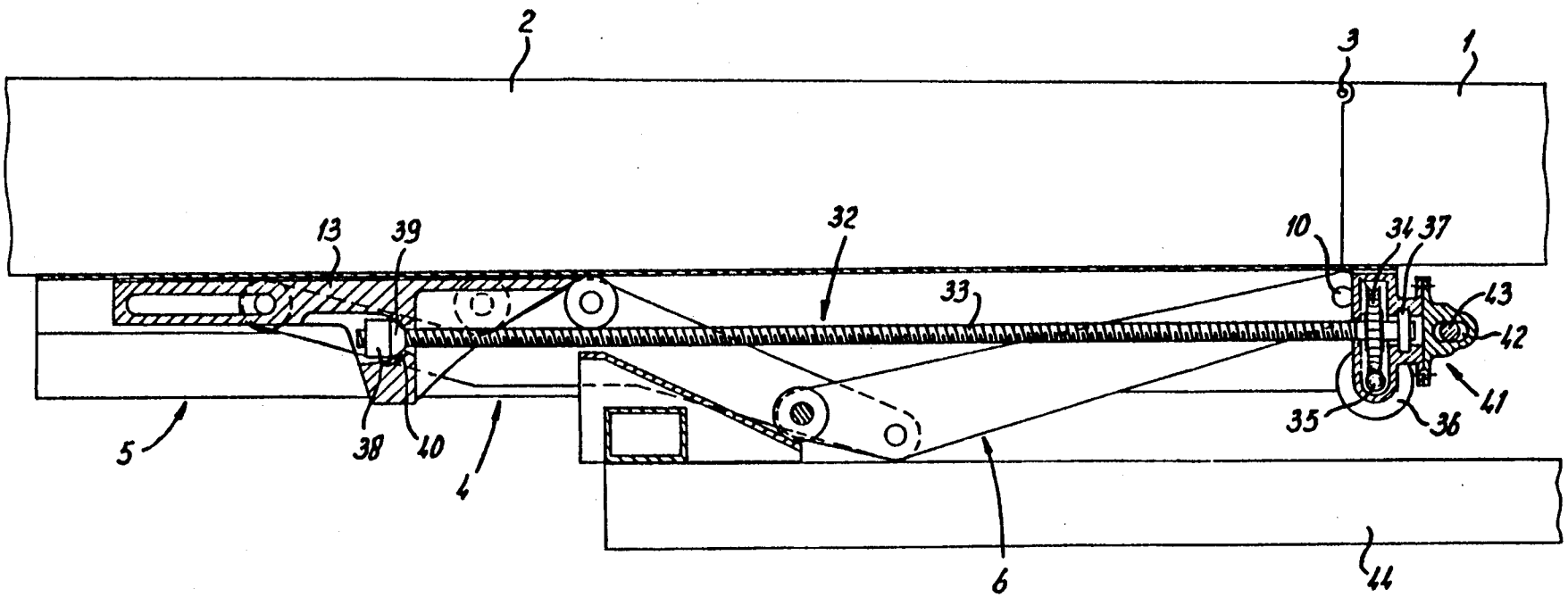

At the position where it is fixed to the U-shaped section, the lead screw 33 is also suspended in a similar way, i.e. so that it can rotate about two axes at right angles to each other, each running at right angles to the lengthwise direction of the lead screw 33. For this purpose, the bearing 37 is accommodated in a housing indicated in its entirety by 41. This housing is provided with an opening 42, through which a supporting pin 43 runs. This supporting pin is fixed to the U-shaped section 5. The housing 41 can now rotate along the axis of the supporting pin. Since the hole 42 also widens out towards both its ends, i.e. in its plane of symmetry parallel to the adjustable part, the housing 41 can also carry out limited movements about an axis at right angles to the plane of symmetry. Oscillatory movements caused by a slight curvature of the lead screw 33 neap the suspension from the U-shaped frame can also be absorbed in this way. All this is shown in greater detail in FIG. 5.

Figure 6:
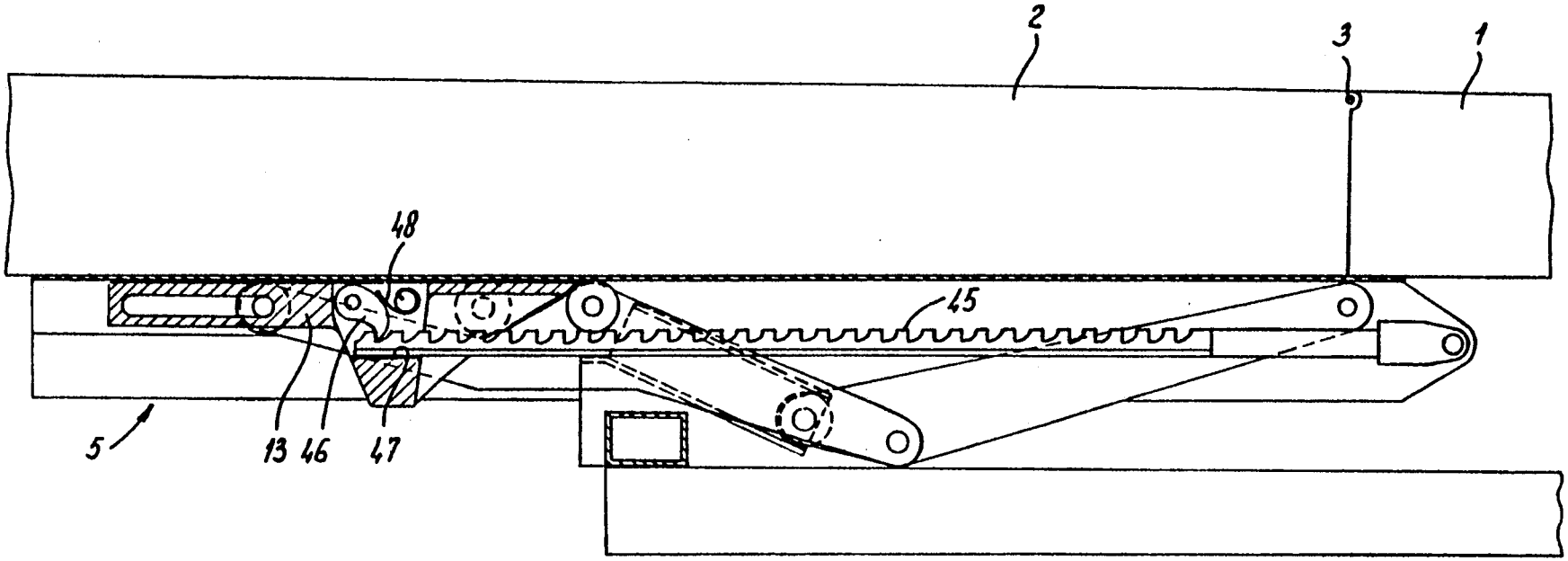
FIG. 6 shows a third embodiment.

In the variant shown in FIG. 6 a ratchet rack 45 is connected near hinge 3 to the section 5. This ratchet rack 45 interacts with a pawl 46 connected to slide block 13. The slide block 13 has a passage 47 through which the ratchet rack can be slid. The pawl 46 is pressed down by spring 48, in such a way that the rack can be slid to the left in the figure, but not to the right relative to the slide block. This means that when the adjustable part 2 is raised by hand to a particular position, the adjustable part locks immediately when it is released. Said part 2 can be moved back again by lifting the pawl 46.

We claim:

1. Device for supporting a human body having parts which are movable relative to each other including a frame; a rotatable end connected thereto; a base element which is connected to said rotatable end; an adjusting element which cooperates with a frame section; and drive means for adjusting the adjusting element relative to the base element, the base element being an elongated section running parallel to at least one of the parts of said frame and said rotatable end and the adjusting element including first and second arms which are movable by means of the drive means between a position in which it extends along or is accommodated in said section and a position in which it projects relative to said section, which arm can be swivelled about a fixed hinge point of the frame and which forms part of a link mechanism with two arms, of which the second arm is coupled with play in a pivoting manner to a sliding member which can be moved relative to the frame, and which second arm has a part which can cooperate in such a way with a control face of the sliding member that the second arm swings out of the initial position at an obtuse angle relative to the first arm, before said play has been passed through.

2. Device according to claim 1 wherein a supporting device is provided proximate the projecting end of one of said arms which cooperates with one of the parts movable relative to each other.

3. Device according to claim 2 wherein the supporting device provides translational movement of said one of said arms over a supporting element having a track on a surface facing the supporting device.

4. Device according to claim 3 wherein said supporting device is a roller element.

5. Device according to claim 3 wherein the supporting device is a sliding element.

6. Device according to claim 2 wherein the play is provided by a slotted hole in the sliding member.

7. Device according to claim 2 wherein said first and second arms are pivotally connected and said second arm is provided with said projecting end extending beyond the location where said arms are pivotally connected and including a supporting device which cooperates with a control face on said frame.

8. Device according to claim 2 wherein when viewed in the direction facing towards the free end of the rotatable end in the collapsed position, the supporting element has an inclined track.

9. Device according to claim 8 wherein the base element has an essentially U-shaped cross-section, and the link mechanism can be accommodated in said base element.

10. Device according to claim 9 wherein the supporting device is situated on a projecting end of said first arm extending beyond a link hinge lying at the side of a hinge joining said rotatable end and said frame.

11. Device according to claim 10 wherein a straight line running through both hinge axes of said first arm provided with said projecting end and a straight line running through said hinge axis and an axis of said supporting device form an angle between them other than 180 degrees.

12. Device according to claim 11 wherein the angle between the two straight lines lying at the side of the base element is smaller than 180 degrees.

13. Device according to claim 10 wherein said second arm situated at a distance from the hinge of the rotatable end is rotatably connected, at its end facing away from the hinge axis to a sliding member which can be slid along the base element.

14. Device according to claim 13 wherein said second arm is rotatably accommodated in a slotted hole provided in the sliding member and extending in the lengthwise direction of the base element, and the sliding member has at its side facing a hinge axis of said first arm a track arranged in that direction, while said second arm connected to the sliding member also has an element for providing translational movement of said second arm along said track in such a way that when the sliding member is slid towards said first arm the translational movement element moves along the track and in the process moves away from the base element while turning the first and second link arms to a more greatly scissored position.

15. Device according to claim 9 wherein the U-shaped base element includes flanges which determine a cross-section with an undercut hollow.

16. Device according to claim 15 wherein the flanges run towards each other, bent through an essentially right angle, at a distance from the bottom of the U-shaped cross-section, in such a way that the bottom and the parts of the base element running towards each other form roller tracks along which guide rollers provided on the sliding member can be rolled.

17. Device according to claim 14 wherein said element for providing translational movement of said second arm is a roller.

18. Device according to claim 14 wherein said element for providing translational movement of said second arm is a sliding member.

19. Device according to claim 8 wherein the section has an essentially L-shaped cross-section, and the adjusting element is a link mechanism which folds adjacent a vertical leg of the L.

20. Device according to claim 1 wherein the sliding member is coupled to a lead screw which is suspended so that it at least rotates about its longitudinal axis near a hinge joining said rotatable part with said frame.

21. Device according to claim 20 wherein the lead screw is fixed in a rotary bearing which itself is fixed in a housing suspended from the bed frame.

22. Device according to claim 21 wherein the housing is rotatable about two intersecting axes running in a plane at a right angle to the axis of the lead screw.

23. Device according to claim 20 wherein the drive means for the lead screw is fixed to the housing.

24. Device according to claim 20 wherein a nut operatively associated with the lead screw is connected to the housing so that it can rotate about two intersecting axes in a plane at a right angle to the lengthwise direction of the lead screw.

25. An adjustable device for supporting a human body having parts which are movable relative to one another comprising:

(a) a frame;
(b) a fixed sub-frame (1) mounted on said frame;
(c) a movable support section rotatably attached to said fixed sub-frame including:
  (i) a movable sub-frame,
  (ii) a support portion mounted on said movable sub-frame,
  (iii) an adjusting device operatively associated with said movable sub-frame and said frame, said adjusting device including a link mechanism comprising:
    (a') a sliding member operatively associated with said movable sub-frame and having a control face,
    (b') a first arm pivotally attached to said movable sub-frame, and
    (c') a second arm, one part of which is operatively associated with said sliding member and a second part of which cooperates during a portion of its range of motion with said control face,
  (iv) drive means, to adjust the adjusting device relative to said movable sub-frame between a first position in which said adjusting device extends along or is accommodated in said movable sub-frame to a second position in which said adjusting device projects from said sub-frame.

26. A bed having a stationary section and at least one end movable with respect to the stationary section including a frame; a rotatable end connected thereto; a base element which is connected to said rotatable end; an adjusting element which cooperates with a frame section, and drive means for adjusting the adjusting element relative to the base element, the base element being an elongated section running parallel to at least one of the parts of said frame and said rotatable end and the adjusting element including first and second arms which are movable by means of the drive means between a position in which it extends along or is accommodated in said section and a position in which it projects relative to said section, which arm can be swivelled about a fixed hinge point of the frame and which forms part of a link mechanism with two arms, of which the second arm is coupled with play in a pivoting manner to a sliding member which can be moved relative to the frame, and which second arm has a part which can cooperate in such a way with a control face of the sliding member that the second arm swings out of the initial position at an obtuse angle relative to the first arm, before said play has been passed through.

27. Bed according to claim 26 including a second adjusting element, each of which adjusting elements is secured to opposing longitudinal edges of said rotatable end.

28. Bed according to claim 27 wherein a single driving means may be employed to operate both adjusting elements.

29. Bed according to claim 28 wherein said driving means comprises a mechanical device.

30. Bed according to claim 28 wherein said driving means comprises a pneumatic device.

31. Bed according to claim 28 wherein said driving means comprises a hydraulic device.

32. Bed according to claim 26 wherein said adjusting device operates in a lengthwise direction which is arranged at a right angle to the lengthwise direction of said bed.

33. Bed according to claim 26 wherein a quick-acting coupling is provided to fix said base element in position.

* * * * *

UNITED STATES PATENT AND TRADEMARK OFFICE

CERTIFICATE OF CORRECTION

PATENT NO. : 5,404,604

DATED : April 2, 1996

INVENTOR(S) : Ken-Ichi Takatori, et al

It is certified that error appears in the above-indentified patent and that said Letters Patent is hereby corrected as shown below:

Column 3, line 5, delete "$DM_2$" and insert --$DM_1$--.

Signed and Sealed this

Twenty-third Day of July, 1996

*Attest:*

Bruce Lehman

BRUCE LEHMAN

*Attesting Officer*

*Commissioner of Patents and Trademarks*